United States Patent [19]

Gagnon et al.

[11] Patent Number: 4,855,634

[45] Date of Patent: Aug. 8, 1989

[54] REFLECTOR AND EYELET CONSTRUCTION FOR REFLECTOR-TYPE LAMPS

[75] Inventors: Peter R. Gagnon, Georgetown; Timothy A. Benson, Winchester, both of Mass.

[73] Assignee: GTE Products Corporation, Danvers, Mass.

[21] Appl. No.: 810,952

[22] Filed: Dec. 19, 1985

[51] Int. Cl.[4] ..... H01J 5/02; H01J 5/36; H01J 5/46

[52] U.S. Cl. ..... 313/113; 313/315; 313/318

[58] Field of Search ..... 313/113, 318, 315

[56] References Cited

U.S. PATENT DOCUMENTS

| | | | |
|---|---|---|---|
| 2,148,314 | 2/1939 | Wright | 176/34 |
| 3,010,045 | 11/1961 | Plagge et al. | 313/318 X |
| 3,515,930 | 6/1970 | Walsh et al. | 313/220 |
| 3,868,531 | 2/1975 | De Fraeye et al. | 313/318 |
| 4,102,558 | 7/1978 | Krachman | 313/318 X |
| 4,181,869 | 1/1980 | Warren et al. | 313/315 |
| 4,264,840 | 4/1981 | Kuhnert et al. | 313/318 X |
| 4,300,189 | 11/1981 | Shanks | 313/113 X |
| 4,456,947 | 6/1984 | Alexander | 313/113 X |
| 4,499,526 | 2/1985 | Tarnay | 362/263 |
| 4,533,851 | 8/1985 | Block et al. | 313/318 X |

*Primary Examiner*—Kenneth Wieder

*Attorney, Agent, or Firm*—Martha Ann Finnegan; José W. Jimenez

[57] ABSTRACT

An electric reflector-type lamp having an improved eyelet construction in which there is utilized a uniquely contoured eyelet fitted into specially shaped apertures in the rear of the glass reflector. The eyelets consist of a hollow cylinder of brass with a bulged center portion which is held firmly within each aperture. The end portions of the eyelet are flared to permanently hold the eyelet in position after insertion. The apertures in the rear of the reflector are comprised of a plurality of sections which accommodate the eyelet and promote sturdy construction. A light source capsule is guided into the apertures by the flared ends of the eyelets, after which the leads are soldered to the eyelets. To seal the lamp and for additional strength, an adhesive can be added around the eyelet.

15 Claims, 2 Drawing Sheets

REFLECTOR AND EYELET CONSTRUCTION FOR REFLECTOR-TYPE LAMPS

CROSS REFERENCE TO COPENDING APPLICATIONS

In Ser. No. 647,316, now abandoned entitled "Bonded Beam Lamp" and filed on Sept. 4, 1985 (Beschle et al), there is described an improved electric lamp and method of making such a lamp which substantially reduces thermally induced strains in both the lens and the reflector once joined together.

In U.S. application Ser. No. 810,957, now abandoned, entitled "A Reflector-Type Lamp Having A Lens with Multi-Functional Details As Part Thereof" and filed concurrently herewith (T. Benson and P. Gagnon), there is described a reflector-type lamp having a plurality of protuberances or depressions disposed substantially on the lens member as means for applying a torque force on the lamp when the lamp is disposed within a socket.

The aforementioned applications are assigned to the same assignee as the instant invention.

TECHNICAL FIELD

The present invention relates in general to incandescent light sources and particularly to the eyelet construction of lamps having two piece envelopes, comprising a reflector and lens assembled with either an adhesive or by flame sealing. The reflector has an internal reflective coating for reflecting and directing light, originating from a light source located within the envelope, towards a cooperating lens through which the light is transmitted.

BACKGROUND OF THE INVENTION

It is well known in the art to utilize PAR (parabolic aluminized reflector) or ER (elliptical reflector) lamps for general spot or floodlighting applications. In particular PAR and ER lamps have become exceptionally popular for short to medium distance outdoor uses as well as indoor for display, decoration, accent, inspection and downlighting applications. Such lamps are manufactured and sold by the assignee of the instant invention. Typically, PAR lamps are of hard glass and include a medium skirt (screw-type) or side pronged base at the rear thereof for connecting the lamp to the desired power source, while ER lamps are made of soft glass and use regular bases.

Motor vehicle headlights are also reflector-type lamps that share similar construction problems with PAR lamps with respect to fastening and sealing the light source to the reflector of the particular unit. In particular, in U.S. Pat. No. 4,181,869, there is disclosed a tungsten halogen lamp sealed in a reflector envelope utilizing lead in conductors or wires which pass through the reflector and are adapted for being supported by an eyelet and an associated lug member. The eyelet extends through an aperture in the glass reflector while the lug interconnects with the eyelet and is adapted to receive an electrical connector external of the reflector envelope. During assembly and manufacture of headlights of the above variety, an adhesive such as an epoxy resin, in a paste or simi-liquid form, is dispensed into cavities or apertures in the glass reflector in order to provide improved sealing and enhanced mechanical strength of the glass reflector to the aforementioned metallic lug and eyelet. In prior art headlights when the lug was fastened to the eyelet and glass, the excess epoxy was often squeezed out to the outside edges of the lug and occasionally onto the glass reflector. In addition, this type of construction requires the use of the aforementioned metallic lug or washer in order to hold the eyelet in place.

It is believed, therefore, that an eyelet construction that simplifies the assembly of a lamp and reduces the cost of manufacturing such a lamp due to the elimination of the washer or lug would be deemed an advancement in the art.

SUMMARY OF THE INVENTION

Therefore it is a primary object of this invention to provide an improved reflector and eyelet construction for reflector type lamps that eliminates the use of a metallic lug or washer for fastening an eyelet to a reflector.

In accordance with one aspect of the instant invention, there is provided an electric lamp comprising a reflector member having two apertures therein, each of the apertures comprised of a plurality of sections of differing dimensions. Two substantially cylindrical eyelets are disposed within and extend through each of the apertures; each of the eyelets having a bulged center portion and two end portions, one of the end portions protruding from the rear of the reflector member and the other of the end portions extending into the interior of the reflector member and having a flared end that fastens the eyelet to the reflector member. The electric lamp also includes a light source disposed within the reflector member having two lead in conductors connected thereto, one end of the lead in conductors supporting the light source and the other end extending through and connected to one of the eyelets.

In accordance with another aspect of the present invention there is provided a molded reflector member for a lamp unit utilizing a light source, the reflector comprising a reflector member having two apertures therein, each of the apertures comprised of a plurality of sections of differing dimensions.

In accordance with another aspect of the present invention, there is provided a method of assembling a reflector-type electric lamp having a light source within a reflector member, the method comprising the steps of providing a reflector member having two apertures therein, each of the apertures comprised of a plurality of sections of differing dimensions and inserting two substantially cylindrical eyelets, each having a bulged center portion and two end portions, from the rear of the reflector and through each of the apertures. The method further includes affixing permanently the eyelets in the apertures by flaring the end portions of the eyelets that extend into the interior of the reflector and inserting the light source having lead in conductors into the reflector, the lead in conductors of the light source being guided into the eyelets by the flared end portions of the eyelets. Finally the light source is affixed to the reflector by soldering at least one of the lead in conductors to one of the eyelets.

BEST MODE FOR CARRYING OUT THE INVENTION

For a better understanding of the present invention together with other and further objects, advantages and capabilities thereof, reference is made to the following disclosure and appended claims in connection with the above described drawings.

Figure 1:
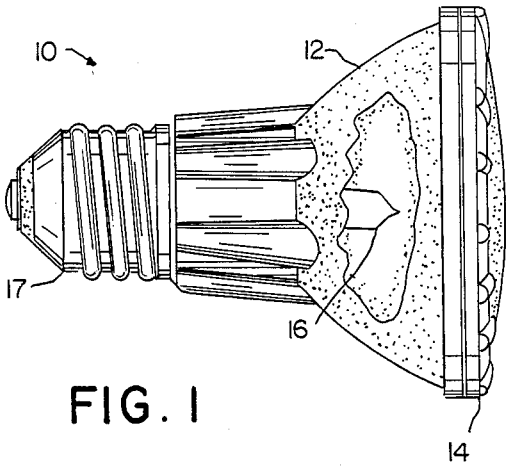
FIG. 1 is a side view, partly in section, of an electric lamp constructed in accordance with the principles of this invention.

With reference now to the drawings, there is shown in FIG. 1 an electric lamp made in accordance with teachings of the present invention. Electric lamp 10 includes a reflector 12, a cooperating lens member 14, a light source 16 and a base 17. Both reflector member 12 and lens member 14 may be joined by either adhesive means or flame sealing to form a lens-reflector seal for lamp 10. Lens member 14 typically has a slightly convex outer face and has an optical prescription provided, for example, by stippling or a series of radially disposed flutes formed on the inner surface thereof. Reflector 14 is preferably a parabolic reflector but it can also be an elliptical reflector or one that typically resembles an automotive headlight reflector.

Electric lamp 10 includes a light source 16 which may either be a sole filament or a tungsten halogen capsule having an envelope containing an inert gas fill and a halogen disposed within. Light source 16 is disposed within and is substantially surrounded by reflector 12 as well as being substantially perpendicular to lens 14. Light source 16 is attached to and supported by lead-in conductors which will be described later in the specification. In aforementioned Ser. No. 647,316, there was disclosed a method of sealing the rear of the reflector involving the insertion of the eyelet through each lead hole of the reflector into a washer or lug, the eyelet being rolled over to secure these two parts together. Next, thermal setting epoxy was used to seal around the eyelet and the eyelet hole was sealed by soldering the capsule lead. The exhaust tube hole is then plugged following epoxy curing with a ball bearing and a different type of adhesive.

Figure 2:
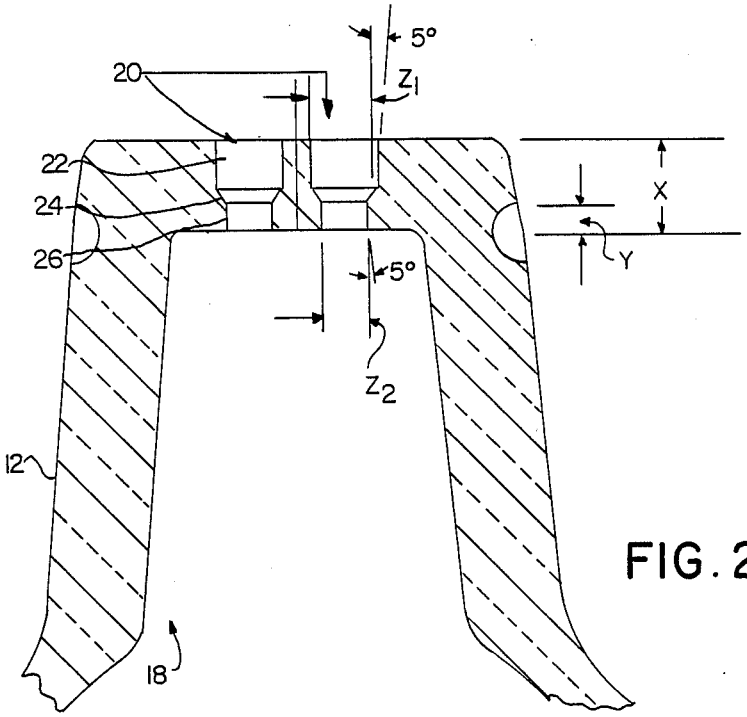
FIG. 2 is a fragmentary, cross sectional view of one embodiment of the reflector of the present invention.

In this new type of construction according to the teachings of this invention, uniquely contoured eyelets are fitted into specially shaped apertures in the back of the glass reflector in order to fasten a light source within the reflector without the use of a washer or a metallic lug. Reference is now made to FIG. 2 which illustrates a fragmentary, cross sectional view of reflector member 12 with reflector interior 18 (as indicated) and at least two apertures 20 disposed in the rear of reflector 12. Apertures 20 of reflector 12 are comprised of a plurality of sections of differing dimensions. The plurality of sections include an outer section 22, which is wide relative to the eyelet diameter (which will be discussed later) with a slight inward taper at the minimum angle required for glass forming; a middle section 24 which tapers in sharply to a small diameter which will guide the eyelet into position and accept it with a minimum amount of clearance thus forming a step; and an inner section 26 which tapers outwardly toward reflector's interior 18 at the minimum angle.

In the preferred embodiment, the minimum angle of outer section 22 is about 5° clockwise from vertical; the angle for the middle section 24 is about 45° clockwise from vertical; and the minimum angle for inner section 26 is about 5 degrees from vertical in the counterclockwise direction. In addition, the entire length of apertures 20 from the rear of reflector 12 to interior 18 is about 0.200 inch which is indicated in FIG. 2 as X and the height of inner section 26 which indicated by the letter Y is equal to about 0.06 inch. The average diameter of outer section 22, which is marked as $Z_1$, is about 0.140 inch and the average diameter of inner section 26, which is marked as $Z_2$, is about 0.100 inch. The midpoint of one aperture to the other aperture of apertures 20 in reflector 12 measures about 0.210 inch.

Figure 3:
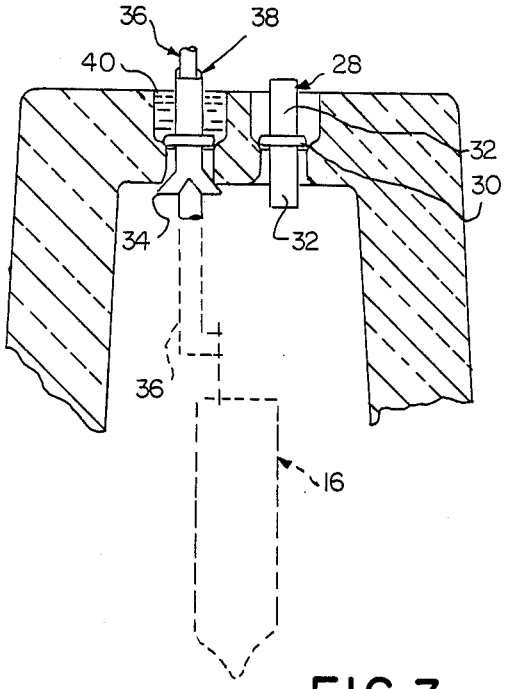
FIG. 3 is a fragmentary, cross sectional view of one embodiment of the eyelet construction made in accordance with the principles of the present invention.

Referring now to FIG. 3, FIG. 3 illustrates the preferred embodiment of the eyelet construction in a reflector-type lamp with a light source 16 shown in phantom. FIG. 3 illustrates one embodiment of eyelet 28 which is preferably made of brass or other metal, that consists of a bulged center portion 30 which may be called a bead an two end portions 32, the eyelet 28 being primarily a hollow cylinder. The inner diameter of eyelet 28 is such that light source 16 or in this case the capsule (as designated) lead will fit through with a minimum of clearance so that the outer diameter is minimized. End portions 32 of eyelet 28 can be flared as indicated by 34 to permanently hold eyelet 28 in position after insertion. Eyelet 28 can also be internally grooved or pregrooved so that the end will split and flare out into a number of equal ears which are forced against the inside edge of aperture 20, as illustrated at 34. FIG. 3 illustrates a lead in conductor 36 from light source 16 that extends through eyelet 28 and is then soldered to eyelet 28 with solder 38. While soldering is the preferred technique other methods such as crimping, welding and brazing are possible.

A quantity of an adhesive 40 may be injected into apertures 20 in order to seal the lamp and provide additional strength to the eyelet construction. The large diameter of outer section 22 relative to eyelet 28 allows adhesive 20 to flow freely into the gap thereby providing a reservoir for adhesive 20 with substantially straight sides for a strong bond. Seating of bead or bulge portion 30 on the step or middle section 24 of aperture 20 effectively holds adhesive 40 in the reservoir preventing detrimental leakage into the lamp. Eyelet 28 is made sufficiently long in order for it to protrude adequately above adhesive 40. As illustrated in FIG. 3, eyelets 28 protrude from the rear of reflector 12 and a portion extends into reflector interior 18.

According to the teachings of the present invention, a method of assembling a reflector type electric lamp having a light source within a reflector member will be described herein. The method comprises the steps of providing a reflective member 12 having apertures 20 therein each of apertures 20 comprised of a plurality of sections of differing dimensions. Two substantially cylindrical eyelets 28 are then inserted from the outside rear of reflector 12 with bead or center portion 30 seating on middle section 24 in aperture 20. With eyelets 28 held firmly, a tool is inserted from the inside of reflector 12 which flares eyelets 28 to permanently fix them in place mechanically, as shown in FIG. 3 by arrow 34. In production, this could be accomplished in one simple operation. Light source 16, along with lead in conductor 36, is inserted from reflectors interior 18 with lead in conductor 36 being guided into aperture 20 by flared end 34. After being properly positioned, light source 16 is fixed in place by soldering one or both of leads 34 to eyelet 28. The small amount of clearance between lead 36 and eyelet 28 results in a small annulus which provides good capillary action to draw the solder into eyelet 28, making a strong bond. Lens member 14 can then be affixed to reflector 12 with, for example, a thermally cured epoxy resin to form a lens-reflector assembly. The lens reflector assembly is then heated, if necessary, and the expanding gases are exhausted through the unsoldered eyelet during thermal curing of the epoxy, after which the remaining lead-in conductor is soldered to the eyelet. A quantity of adhesive 40 can be deposited around end portion 32 protruding from the rear of reflector 12 thereby increasing the strength of the eyelet construction and resulting in a hermetic seal.

This invention offers several advantages over previous types of eyelet construction. It eliminates the use of washers or lugs thus reducing material costs and simplifying assembly. Since the eyelet is mechanically affixed to the reflector, light capsule leads can be soldered or otherwise attached before epoxy curing. By soldering only one lead before hand, expanding gases in the reflector can be vented through the remaining hole during thermal curing of the epoxy. This eliminates the need for a separate exhaust hole which must be later sealed with additional materials. If the lamp need not be sealed, the epoxy around the eyelets can be omitted altogether. This type of construction is applicable to various lamp-types including PAR, ER and motor vehicle headlights.

With respect to the reflector construction, the plurality of sections within apertures 20 in another embodiment may be cylindrical in dimension. It is also possible to omit the middle section and only have outer section 22 and inner section 26 as another possible embodiment. Different combinations of section dimensions are also possible such as combining some cylindrical with other angled sections. Also the reflector disclosed being made of glass but it can also be made from plastic. With respect to the eyelets, the eyelets are preferably made of brass but they may also be made of materials selected from the group consisting of aluminum, copper, steel, and a nickel-iron alloy.

While there have been shown and described what are at present the preferred embodiments of the invention, it will be obvious to those skilled in the art that various changes and modifications may be made therein without departing from the scope of the invention as defined by the appended claims.

What is claimed is:

1. An electric lamp comprising:

a reflector member having two apertures therein, each of said apertures comprised of a plurality of sections of differing dimensions;

two substantially cylindrical eyelets disposed within and extending through each of said apertures each of said eyelets having a bulged center portion and two end portions, one of said end portions protruding from the rear of said reflector member and the other of said end portions extending into the interior of said reflector member and having a flared end that fastens said eyelets to said reflector member; and a light source disposed within said reflector member having two lead in conductors connected thereto, one end of said lead in conductors supporting said light source and the other end extending through and connected to one of said eyelets.

2. The lamp according to claim 1 wherein said plurality of sections include an outer section adjacent the rear of said reflector and an inner section adjacent the interior of said reflector, a portion of said outer section having a diameter substantially equal to the diameter of the bulged center portion of said eyelets and a portion of said inner section having a diameter substantially equal to the diameter of said end portions of said eyelets.

3. The lamp according to claim 2 wherein said outer and inner sections of said apertures are substantially cylindrical in dimension.

4. The lamp according to claim 2 wherein said outer section of said apertures tapers inwardly and said inner section of said apertures tapers outwardly toward said reflector's interior.

5. The lamp according to claim 1 wherein said plurality of sections include an outer section adjacent the rear of said reflector, an inner section adjacent the interior of said reflector and a middle section disposed between said outer and said inner sections.

6. The lamp according to claim 5 wherein a portion of said middle section has a diameter substantially equal to the diameter of the bulged center portion of said eyelets, a portion of said inner section has a diameter substantially equal to the diameter of said end portions of said eyelets, and a portion of said outer section has a diameter greater than the maximum diameter of said middle section.

7. The lamp according to claim 6 wherein said outer, inner and middle sections of said apertures are substantially cylindrical in dimension.

8. The lamp according to claim 6 wherein said outer section of said apertures tapers inwardly, said inner section tapers outwardly toward said reflector's interior, and said middle section tapers sharply inwardly from said outer section to said inner section thereby guiding said eyelets into proper position within said apertures.

9. The lamp according to claim 1 wherein each of said lead in conductors are affixed to said respective eyelets.

10. The lamp according to claim 9 wherein the diameter of the interior of said eyelets is of such a size that a small amount of clearance between said lead in conductor and said eyelet will provide good capillary action upon soldering to draw solder into said eyelet thereby forming a strong eyelet-conductor bond.

11. The lamp according to claim 1 wherein said eyelets are internally pregrooved to ease flaring of one end of said portions.

12. The lamp according to claim 1 wherein said eyelets are made of brass.

13. The lamp according to claim 1 wherein said eyelets are made of a material selected from the group consisting of aluminum, brass, copper, steel and a nickel-iron alloy.

14. The lamp according to claim 1 wherein said electric lamp further includes a quantity of an adhesive located within a portion of each of said apertures and surrounding a portion of each of said eyelets.

15. The lamp according to claim 14 wherein said electric lamp further includes a lens member in contact with said reflector.

* * * * *